US011320852B2

(12) United States Patent
Inoue et al.

(10) Patent No.: US 11,320,852 B2
(45) Date of Patent: May 3, 2022

(54) FORCE SENSE IMPARTING OPERATION DEVICE

(71) Applicants: Kobe Steel, Ltd., Kobe (JP); KOBELCO CONSTRUCTION MACHINERY CO., LTD., Hiroshima (JP)

(72) Inventors: Koji Inoue, Kobe (JP); Hiroshi Hashimoto, Kobe (JP)

(73) Assignees: Kobe Steel, Ltd., Kobe (JP); KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 16/648,095

(22) PCT Filed: Aug. 24, 2018

(86) PCT No.: PCT/JP2018/031332
§ 371 (c)(1),
(2) Date: Mar. 17, 2020

(87) PCT Pub. No.: WO2019/058870
PCT Pub. Date: Mar. 28, 2019

(65) Prior Publication Data

US 2021/0026393 A1 Jan. 28, 2021

(30) Foreign Application Priority Data

Sep. 20, 2017 (JP) ..... JP2017-180419

(51) Int. Cl.
*G05G 5/03* (2008.04)

(52) U.S. Cl.
CPC ..... *G05G 5/03* (2013.01)

(58) Field of Classification Search
None
See application file for complete search history.

(56) References Cited

U.S. PATENT DOCUMENTS

2012/0143441 A1 6/2012 Yamazaki et al.
2016/0216726 A1* 7/2016 Inoue ..... G05G 1/04

FOREIGN PATENT DOCUMENTS

JP 2011-108063 A 6/2011
JP 2012-116355 A 6/2012
JP 2015-72669 A 4/2015

OTHER PUBLICATIONS

International Search Report dated Nov. 6, 2018 in PCT/JP2018/031332 filed Aug. 24, 2018, 1 page.

* cited by examiner

*Primary Examiner* — Vicky A Johnson
(74) *Attorney, Agent, or Firm* — Oblon, McClelland, Maier & Neustadt, L.L.P.

(57) ABSTRACT

A force sense imparting operation device that imparts a force sense in accordance with a load acting on an actuation device. The device includes an operation member, a displacement detector, a load detector, a force sense generator that imparts a force sense to an operator who operates the operation member, a current controller that performs an actual control and a preliminary control, the actual control increasing the force sense imparted by the force sense generator by increasing an excitation current in response to an increase in the load, the preliminary control supplying the excitation current to an excitation coil prior to the actual control, the excitation current supplied by the preliminary control being set to a preliminary current value lower than the excitation current supplied to the excitation coil under the actual control, and a current supplying portion that supplies the excitation current to the excitation coil.

6 Claims, 12 Drawing Sheets

FORCE SENSE IMPARTING OPERATION DEVICE

CROSS-REFERENCE TO RELATED APPLICATIONS

This application is a United States national stage application of International Application No. PCT/JP2018/031332, filed Aug. 24, 2018, which designates the United States, and claims priority to Japan Patent Application No. 2017-180419, filed Sep. 20, 2017, and the entire contents of each of the above applications are hereby incorporated herein by reference in entirety.

TECHNICAL FIELD

The present invention relates to a force sense imparting operation device configured to impart a force sense via an operation member to an operator operating a working machine with the operation member.

BACKGROUND ART

An operator operates a working machine such as a crane using an operation member such as an operation lever. For example, when the operator pulls the operation lever, the crane turns to the left. In contrast, when the operator pushes the operation lever, the crane turns to the right. The operation of the operation lever may be associated with the motion of the crane by an electric control system. In such a case, a load applied to a turning part of the crane is not physically transmitted to the operation lever. Consequently, the operator may operate the operation lever without consideration for the load applied to the turning part of the crane. Consequently, an excessive load may be applied to the crane or an inappropriate motion may be happened to the crane because of the operator operating the operation lever so as to rapidly turn the crane under a condition in which a high load is applied to the turning part of the crane.

Patent Document 1 proposes techniques of supplying an excitation current to a coil to impart a force sense in correspondence with the load applied to the turning part of the crane to an operator through an operation lever. With regard to the techniques disclosed in Patent Document 1, when a high load acts on the turning part of the crane, a high force sense is transmitted to the operator through the operation lever. Accordingly, the operator may feel the load acting on the crane and perform an operation suitable for the load acting on the crane.

A coil-system for generating a force sense inevitably includes an inductance. A coil-system designed to impart a high force sense to an operator has a high inductance. A higher inductance causes a larger response lag, which may discourage imparting a force sense of a proper magnitude at a right timing to the operator operating the operation member. With regard to responsiveness, a conventional force sense imparting operation device is yet to be improved.

CITATION LIST

Patent Document

Patent Document 1: JP 2015-72669 A

SUMMARY OF INVENTION

An object of the present invention is to provide a force sense imparting operation device having improved responsiveness.

A force sense imparting operation device according to one aspect of the present invention imparts a force sense in accordance with a load acting on an actuation device which performs a predetermined motion in response to a motion request output when there is an operation causing a displaced amount exceeding a predetermined displacement threshold value from a predetermined neutral position under a stationary condition of the actuation device. The force sense imparting operation device includes an operation member operated to be displaced from the neutral position; a displacement detector configured to detect the displaced amount of the operation member from the neutral position; a load detector configured to detect the load acting on the actuation device which starts the predetermined motion in response to the motion request output when the displaced amount of the operation member exceeds the displacement threshold value; a force sense generator including an excitation coil to which an excitation current is supplied, the force sense generator being configured to generate resistance against a displacement of the operation member by the excitation current supplied to the excitation coil, so that the force sense generator imparts the force sense to an operator operating the operation member; a current controller configured to perform an actual control, under which the force sense imparted by the force sense generator is increased by increasing the excitation current in response to an increase in the load detected by the load detector, and a preliminary control, under which the excitation current set to a preliminary current value lower than the excitation current supplied to the excitation coil under the actual control is supplied to the excitation coil prior to the actual control; and a current supplying portion configured to supply the excitation current to the excitation coil under control of the current controller. The current controller performs the preliminary control when the displaced amount increases and exceeds the displacement threshold value, so that the current controller supplies the excitation current set to the preliminary current value from the current supplying portion to the excitation coil.

The force sense imparting operation device has improved responsiveness.

Objects, features, and advantages of the present invention becomes clear from the following description and accompanying drawings.

DESCRIPTION OF EMBODIMENTS

Figure 1:
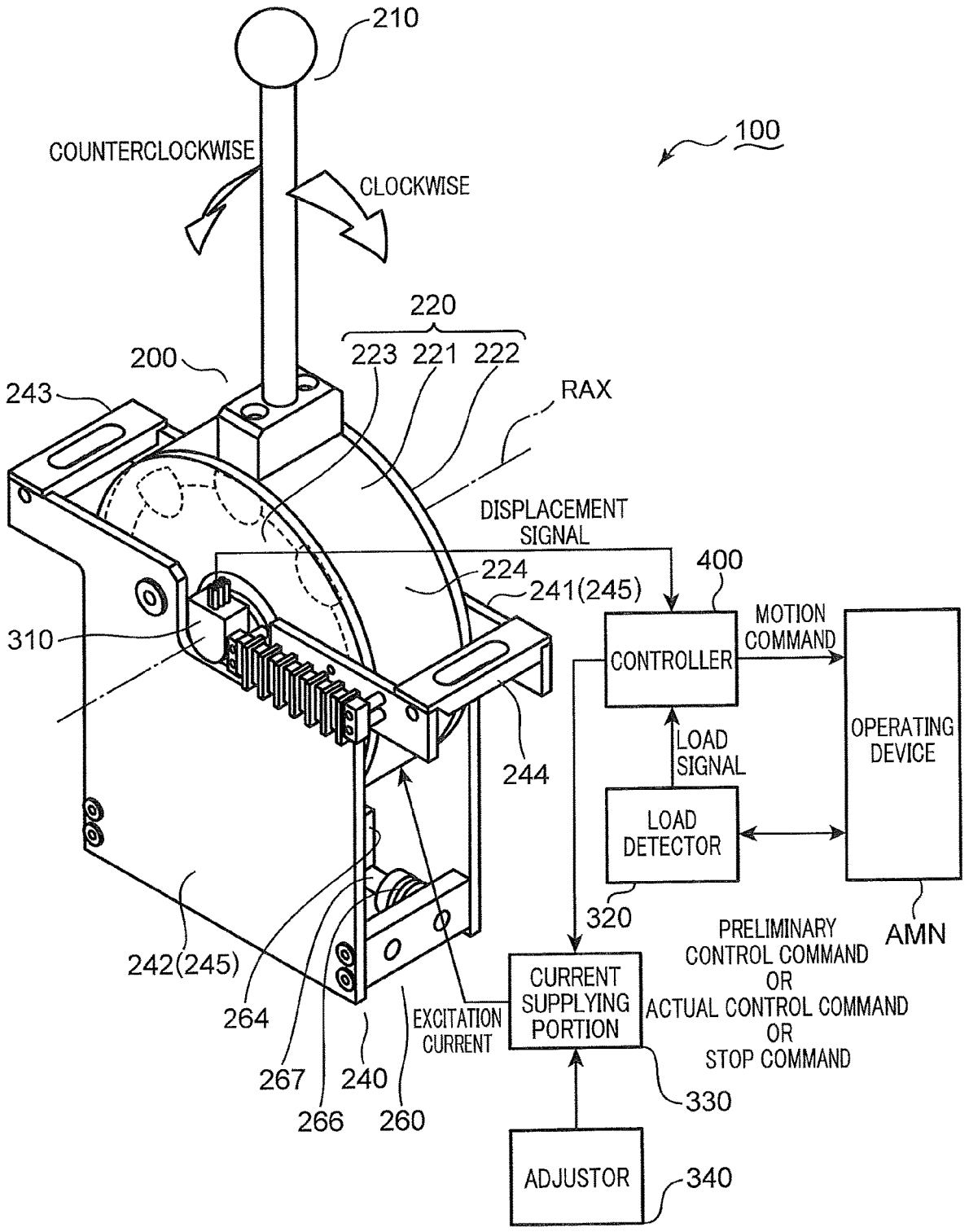
FIG. 1 is a conceptual view of an exemplary force sense imparting operation device.
Figure 2:
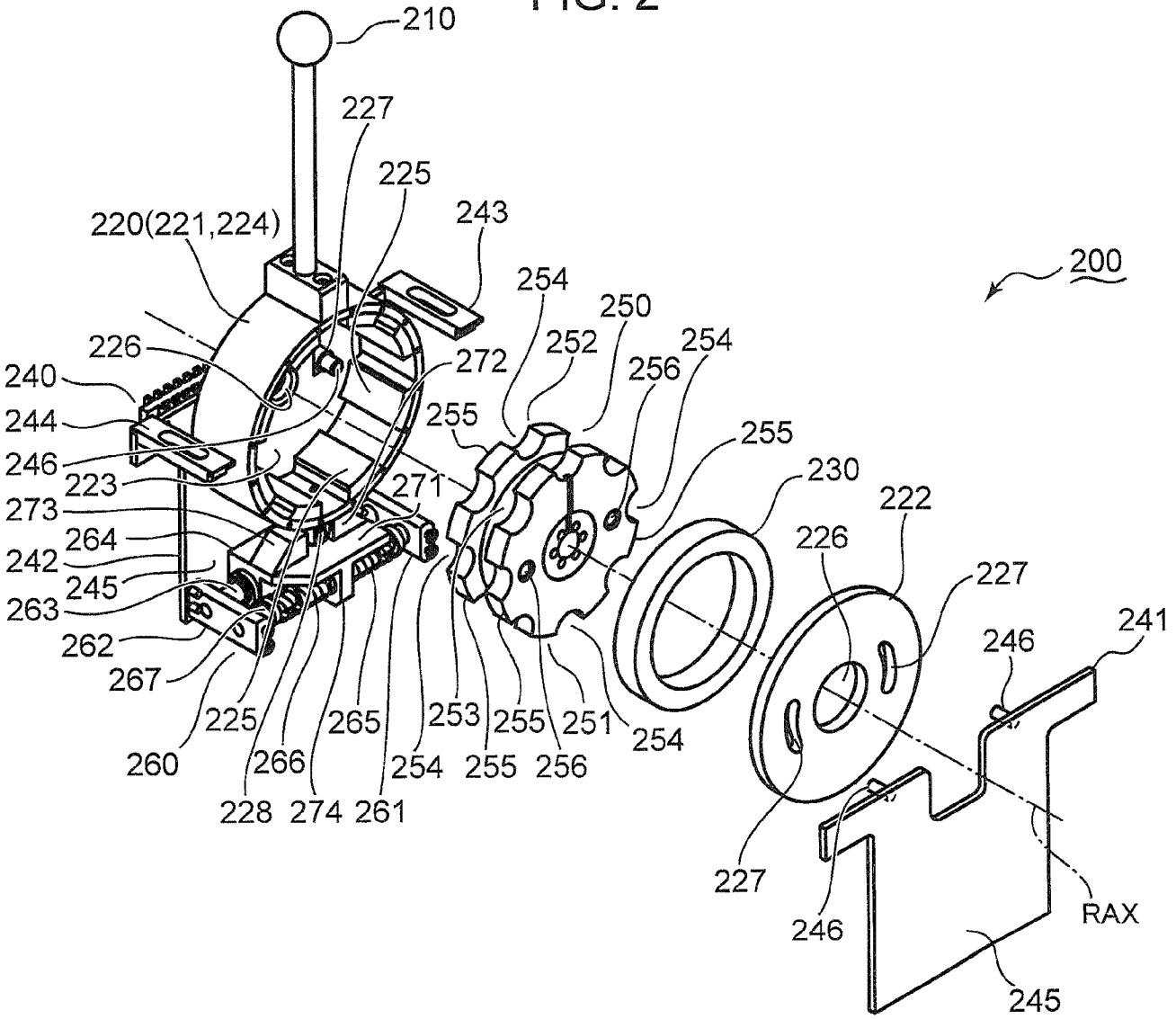
FIG. 2 is a schematic exploded perspective view of an operation portion of the force sense imparting operation device shown in FIG. 1.

FIG. 1 is a conceptual view of an exemplary force sense imparting operation device (hereinafter referred to as "operation device 100"). FIG. 2 is a schematic exploded perspective view of an operation portion 200 of the operation device 100. The operation device 100 is described with reference to FIG. 1. Terms "up", "down", "vertical", "horizontal", "clockwise" and "counterclockwise" are used herein to indicate directions. These directional terms are used only for clarification of the description. The directional terms do not limit the principle of the present embodiment.

The operation device 100 includes an operation portion 200, a displacement detector 310, a load detector 320, a current supplying portion 330 and a controller 400. The operation portion 200 includes an operation member 210, a rotational portion 220, an excitation coil 230, a holder 240, an iron core 250 and an urging mechanism 260. The rotational portion 220 is a cylindrical member configured to rotate about a predetermined rotational axis RAX. The operation member 210 is a lever extending upward from an outer circumferential surface of the rotational portion 220. An operator may operate the operation member 210 so that the operation member 210 angularly moves about the rotational axis RAX. The excitation coil 230 and the iron core 250 are situated inside the rotational portion 220. Unlike the rotational portion 220 rotatable about the rotational axis RAX, the excitation coil 230 and the iron core 250 are fixed to the holder 240. When the current supplying portion 330 supplies an excitation current to the excitation coil 230 under control of the controller 400, the excitation coil 230 and the iron core 250 generate a force against rotation of the rotational portion 220 about the rotational axis RAX in accordance with the operation given to the operation member 210. The rotational part 220, the excitation coil 230 and the iron core 250 constitute a force sense generator which generates resistance against the angular displacement of the operation member 210 about the rotational axis RAX to impart a force sense to the operator. Like the excitation coil 230 and the iron core 250, the urging mechanism 260 is fixed to the holder 240. The urging mechanism 260 generates an urging force acting in a direction in which the operation member 210 returns to the neutral position. Accordingly, when the operator releases the operation member 210 from the hand, the operation member 210 returns to the neutral position by itself.

The operation member 210 shown in FIG. 1 is at the neutral position. The actuation device AMN stays stationary at this state. With regard to the present embodiment, the crane is used as the actuation device AMN. Another working machine may be used as the actuation device AMN. In addition, the term "actuation device" may refer to the whole working machine or a part of a device assembled in the working machine. The principle of the present embodiment is not limited to a particular machine or device used as the actuation device AMN. The controller 400 may be a microcomputer mounted in the actuation device AMN.

The operation member 210 at the neutral position is substantially vertical. The displacement detector 310 detects an angularly displaced amount (hereinafter referred to as displaced amount) of the rotational portion 220 about the rotational axis RAX from the neutral position and a displaced direction (clockwise or counterclockwise). With regard to the present embodiment, a rotary encoder attached to the operation portion 200 on the rotational axis RAX is used as the displacement detector 310. However, the displacement detector 310 may be another sensor device configured to detect the displaced amount and the displaced direction of the rotational part 220. The principle of the present embodiment is not limited to a particular sensor device used as the displacement detector 310.

The displacement detector 310 generates a displacement signal indicating a displaced amount and a displaced direction. The displacement signal is output from the displacement detector 310 to the controller 400. The controller 400 refers to the displacement signal and makes the actuation device AMN perform a motion in accordance with the displaced amount and the displaced direction. The operator may operate the operation member 210 to make the actuation device AMN perform a desired motion.

A crane used as the actuation device AMN may be turned to the left when the operator rotates the operation member 210 clockwise. The crane may be turned to the right when the operator rotates the operation member 210 counterclockwise. The crane turns by a large angle when the displacement detector 310 detects a large displaced amount. The crane turns by a small angle when the displacement detector 310 detects a small displaced amount.

While the actuation device AMN operates under control of the controller 400 as described above, a load in accordance with the work environment and/or the work condition acts on the actuation device AMN. The load detector 320 detects the load acting on the actuation device AMN. With regard to the present embodiment, the load detector 320 detects a load acting on the turning part of the crane used as the actuation device AMN. For example, the load detector 320 may detect a load on a hydraulic motor for turning the turning part of the crane. Various sensor devices suitable for a target part at which a load is detected may be used as the load detector 320. The principle of the present embodiment is not limited to a particular sensor device used as the load detector 320.

The controller 400 controls not only the actuation device AMN but also the current supplying portion 330 configured to supply an excitation current to the excitation coil of the force sense generator of the operation portion 200. The excitation coil to which the excitation current is supplied provides the rotational part 220 with a force against the rotation of the rotational part 220. Accordingly, the operation device 100 makes the operator feel a force sense. The current supplying portion 330 may be a typical driver circuit configured to supply a current. The principle of the present embodiment is not limited to a particular electrical configuration of the current supplying portion 330.

The excitation coil 230 may be a conductive wire (e.g. a copper wire) simply wound about the rotational axis RAX or a pancake coil (a strip-like conductive material made of a conductive wire wound in a flatwise manner about the rotational axis RAX). The principle of the present embodiment is not limited to a particular structure of the excitation coil 230.

The iron core 250 is magnetized by supplying the excitation current from the current supplying portion 330 to the excitation coil 230. The iron core 250 includes two stator plates 251, 252 and a connecting shaft 253. The connecting shaft 253 is provided between the stator plates 251, 252 to be coaxial with the rotational axis RAX. The connecting shaft 253 is a column-shaped member integrally formed with the stator plates 251, 252. The iron core 250 is made of a material having a high magnetic permeability (i.e. a soft magnetic material). The excitation coil 230 is situated to surround the connecting shaft 253 around the rotational axis RAX.

Each of the stator plates 251, 252 is a disk-like plate member situated coaxially with the rotational axis RAX. Each of the stator plates 251, 252 is larger in an outer diameter than the connecting shaft 253. Therefore, an axial displacement of the excitation coil 230 situated between the stator plates 251, 252 (i.e. a displacement of the excitation coil 230 along the extending direction of the rotational axis RAX) is interfered by the stator plates 251, 252.

A circumferential rim of each of the stator plates 251, 252 has notches 254. The notches 254 are provided substantially at regular intervals around the rotational axis RAX. Therefore, there are projections 255 provided substantially at regular intervals around the rotational axis RAX. A distal surface of each of the projections 255 faces an inner circumferential surface of the rotational part 220. Due to the excitation current supplied to the excitation coil 230, magnetic flux lines concentrate at the distal surface of each of the projections 255 to form a magnetic pole.

The rotational part 220 includes a rotor 221 and two rotor plates 222, 223. The rotor 221 includes an outer shell ring 224 and magnetic pole portions 225. The outer shell ring 224 has a cylindrical shape having an outer circumferential surface to which the operation member 210 is fixed. Each of the magnetic pole portions 225 protrudes toward the rotational axis RAX from the inner circumferential surface of the outer shell ring 224. The outer shell ring 224 is coaxial with the rotational axis RAX. Like the projections 255 of each of the stator plates 251, 252, the magnetic pole portions 225 are situated substantially at regular intervals around the rotational axis RAX. The magnetic pole portions 225 is as many as the projections 255. Like the iron core 250, the magnetic pole portions 225 are made of a material having high magnetic permeability (i.e. a soft magnetic material).

An assembly of the excitation coil 230 and the iron core 250 is situated inside the outer shell ring 224. When the distal surfaces of the magnetic pole portions 225 of the rotor 221 face the distal surfaces of the projections 255 of the stator plates 251, 252, there is a small gap between the distal surfaces facing each other. Therefore, the rotor 221 does not interfere with the iron core 250 when the rotor 221 is rotated under an operation of the operation member 210.

The rotor 221 is situated between the two rotor plates 222, 223 and connected to the two rotor plates 222, 223. As shown in FIG. 2, an substantially circular through hole 226 and two are slots 227 are formed in each of the rotor plates 222, 223. The through hole 226 is coaxial with the rotational axis RAX. The curvature center of the arc slot 227 is on the rotational axis RAX.

The holder 240 includes two supporting plates 241, 242 and two connecting arms 243, 244. The supporting plates 241, 242 are arranged along the extending direction of the rotational axis RAX so as to be substantially orthogonal to the rotational axis RAX. The connecting arms 243, 244 are situated between the supporting plates 241, 242 to extend substantially in parallel to the rotational axis RAX. Both ends of each of the connecting arms 243, 244 are fixed to the supporting plates 241, 242. Therefore, there is a square horizontal region surrounded by the supporting plates 241, 242 and the connecting arms 243, 244. The rotational part 220 in which there is the assembly of the excitation coil 230 and the iron core 250 is situated in the square horizontal region.

Each of the supporting plates 241, 242 includes a plate portion 245 and two engaging pins 246. The plate portion 245 is fixed to the ends of the connecting arms 243, 244. The two engaging pins 246 protrude from the plate portion 245 to the inside of the rotational part 220. Two engaging holes 256 in correspondence to the two engaging pins 246 are formed in each of the stator plates 251, 252. The two engaging pins 246 are inserted through the two arc slots 227 into the two engaging holes 256. Therefore, the holder 240 supports the rotational part 220 in which there is the assembly of the excitation coil 230 and the iron core 250. The assembly of the excitation coil 230 and the iron core 250 is fixed by the four engaging pins 246 of the supporting plates 241, 242 whereas the rotational part 220 may rotate about the rotational axis RAX within an extending range of the arc slots 227.

The urging mechanism 260 is situated below the rotational part 220. The urging mechanism 260 includes two connecting arms 261, 262, a guide rod 263, a displaceable block 264, two coil springs 265, 266 and a core bar 267. The connecting arm 261 of the urging mechanism 260 is situated below the connecting arm 243 of the holder 240 and extends substantially in parallel to the rotational axis RAX. The connecting arm 262 of the urging mechanism 260 is situated below the connecting arm 244 of the holder 240 and extends substantially in parallel to the rotational axis RAX. Like the connecting arms 243, 244 of the holder 240, both ends of each of the connecting arms 261, 262 of the urging mechanism 260 are connected to the supporting plates 241, 242. The urging mechanism 260 is thereby supported by the holder 240.

The guide rod 263 extends between the connecting arms 261, 262. Both ends of the guide rod 263 are fixed to the connecting arms 261, 262. The guide rod 263 is substantially perpendicular to the rotational axis RAX three dimensionally.

The displaceable block 264 has a built-in bearing (not shown). The guide rod 263 extends through the bearing in the displaceable block 264. Therefore, the displaceable block 264 is displaceable along the guide rod 263.

The displaceable block 264 includes a horizontal plate 271 and two connecting ribs 272, 273. The connecting ribs 272, 273 protrude from the top surface of the horizontal plate 271. The connecting rib 273 is distant from the connecting rib 272 in the extending direction of the guide rod 263. The rotational part 220 includes a protrusion 228 protruding downward from the outer shell ring 224. The protrusion 228 is fit in a gap between the connecting ribs 272, 273. The protrusion 228 is provided on a vertical line extending from the operation member 210 at the neutral position. One of the connecting ribs 272, 273 is pushed by the protrusion 228 when the operator rotates the operation member 210 clockwise or counterclockwise. The displaceable block 264 is thereby displaced along the guide rod 263.

The displaceable block 264 includes a partition wall 274 which protrudes from a bottom surface of the horizontal plate 271 to partition the coil spring 265 from the coil spring 266. Like the guide rod 263, the core bar 267 extends through the partition wall 274 substantially in parallel to the guide rod 263 between the connecting arms 261, 262. The displaceable block 264 may be displaced along the guide rod 263 and the core bar 267. Both ends of the core bar 267 are connected to the connecting arms 261, 262. The coil spring 265 wound on the core bar 267 is situated between the connecting arm 261 and the partition wall 274. The coil spring 266 wound on the core bar 267 is situated between the connecting arm 262 and the partition wall 274. The coil spring 265 is compressed when the operator rotates the operation member 210 clockwise or counterclockwise. When the operator releases the operation member 210 from the hand, resilience of the compressed coil spring 265 causes the displaceable block 264 to be displaced along the guide rod 263 and the core bar 267, so that the operation member 210 returns to the neutral position. The coil spring 266 is compressed when the operator rotates the operation member 210 counterclockwise or clockwise. When the operator releases the operation member 210 from the hand, resilience of the compressed coil spring 266 causes the displaceable block 264 to be displaced along the guide rod 263 and the core bar 267, so that the operation member 210 returns to the neutral position.

Figure 3:
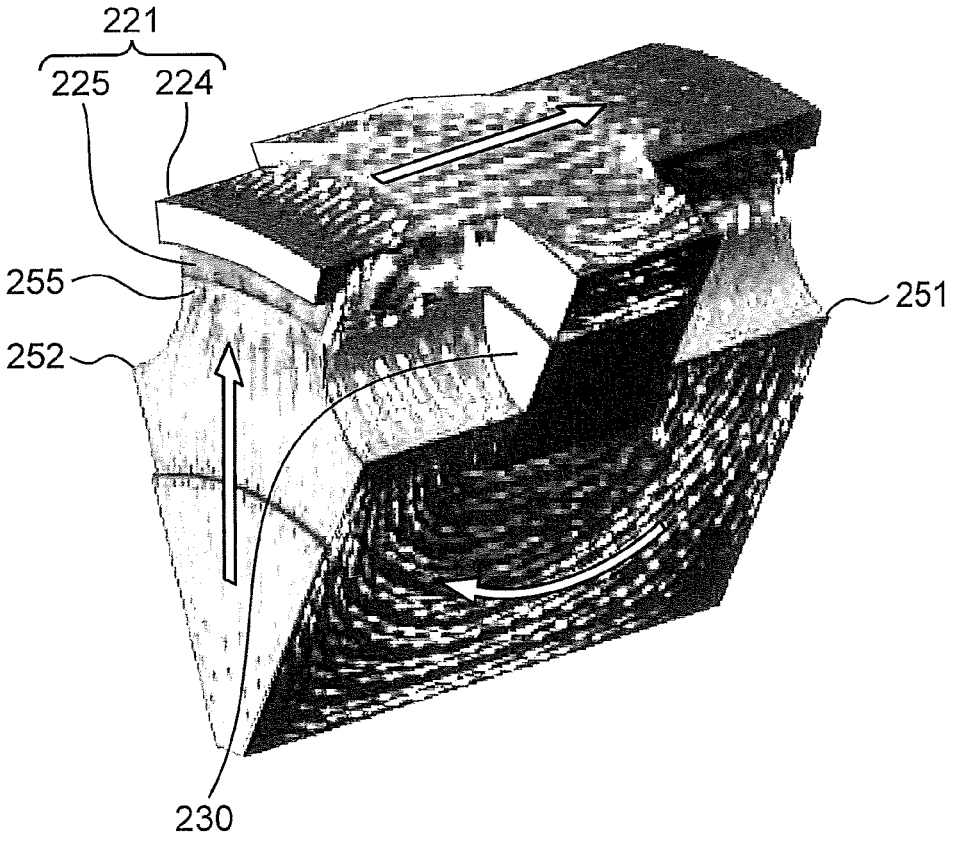
FIG. 3 is a schematic cross-sectional view of a rotational portion of the operation portion shown in FIG. 2.

FIG. 3 is a schematic cross-sectional view of the rotational part 220 in a virtual plane including the rotational axis RAX. The operation portion 200 is further described with reference to FIGS. 2 and 3.

The excitation current flowing in the excitation coil 230 generates a magnetic circuit which encircles a cross-section of the excitation coil 230 as shown by the arrow in FIG. 3. When the operator operates the operation member 210 to rotate the rotor 221 about the rotational axis RAX, there is a change in a distance between the rotor 221 and the stator plates 251, 252. A magnetoresistance between the rotor 221 and the stator plates 251, 252 becomes minimum when the magnetic pole portion 225 of the rotor 221 directly faces the projections 255 of the stator plates 251, 252 as shown in FIG. 3. The magnetoresistance between the rotor 221 and the stator plates 251, 252 becomes the maximum when the magnetic pole portion 225 of the rotor 221 directly faces the notches 254 of the stator plates 251, 252. Under a supply of the excitation current to the excitation coil 230, a force acts on the rotor 221 in a direction that the magnetoresistance decreases between the rotor 221 and the stator plates 251, 252. Since the force acting in a direction that the magnetoresistance decreases between the rotor 221 and the stator plates 251, 252 acts against the rotation of the rotor 221, the operator may feel a force sense.

Figure 4:
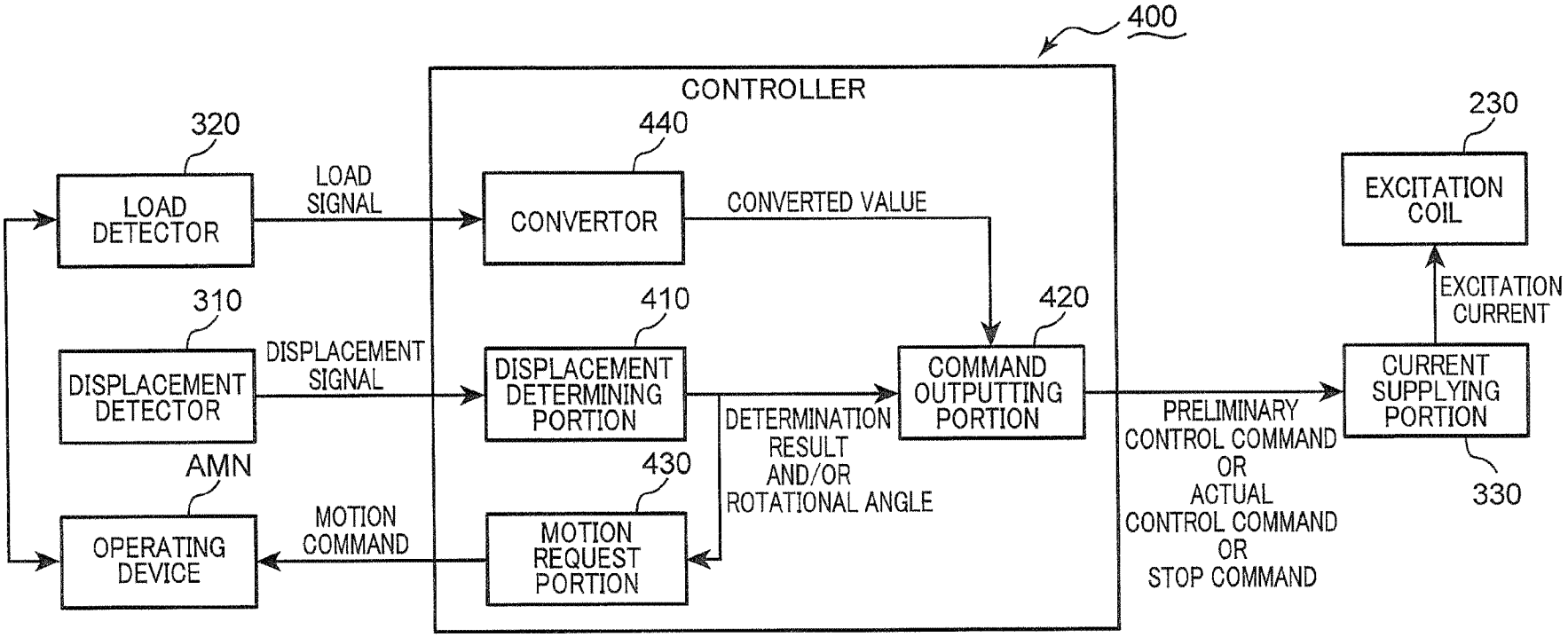
FIG. 4 is a schematic block diagram shown an exemplary functional configuration of a controller of the force sense imparting operation device shown in FIG. 1.

FIG. 4 is a schematic block diagram showing an exemplary functional configuration of the controller 400. The operation device 100 is further described with reference to FIGS. 1 and 4.

The controller 400 includes a displacement determining portion 410, a command outputting portion 420, a motion request portion 430 and a convertor 440. The displacement determining portion 410, the command outputting portion 420 and the convertor 440 are used as a current controller to control the excitation current supplied to the excitation coil 230.

As described above, the displacement detector 310 generates the displacement signal to indicate a displaced amount and a displaced direction of the rotational part 220. The displacement signal is output from the displacement detector 310 to the command outputting portion 420 and the motion request portion 430 through the displacement determining portion 410. The displacement determining portion 410 refers to the displacement signal to determine whether the displaced amount indicated by the displacement signal exceeds a predetermined displacement threshold value. A clockwise or counterclockwise angular range determined by the displacement threshold value from the neutral position is set as a neutral angular range. The controller 400 is designed to ignore a rotational operation of the operation member 210 within the neutral angular range. Accordingly, even if the operator accidentally contacts the operation member 210 to rotate the operation member 210, such an accidental contact is not likely to affect an operation of the actuation device AMN.

When the displaced amount indicated by the displacement signal exceeds the predetermined displacement threshold value, the displacement determining portion 410 informs the command outputting portion 420 and the motion request portion 430 of a determination result indicating that the displaced amount exceeds the neutral angular range. On receiving the determination result indicating that the displaced amount exceeds the neutral angular range, the command outputting portion 420 generates a preliminary control command to instruct a supply of an excitation current of a preliminary current value. The preliminary control command is output from the command outputting portion 420 to the current supplying portion 330. Under the preliminary control on the basis of the preliminary control command, the current supplying portion 330 generates an excitation current of a value instructed by the preliminary control command. The excitation current is supplied from the current supplying portion 330 to the excitation coil 230 provided in the operation portion 200. The excitation current is supplied to the excitation coil 230 under the preliminary control in order to improve responsiveness of imparting a force sense of the operation device 100. The excitation current supplied under the preliminary control is preferably set so as not to make the operator feel a force sense. In this case, the excitation current supplied under the preliminary control does not affect the operation of the operation member 210 made within the neutral angular range.

On receiving the determination result indicating that the displaced amount exceeds the neutral angular range, the motion request portion 430 generates a motion command to request that the actuation device AMN starts a particular motion (e.g. a turning motion). The motion command is output from the motion request portion 430 to the actuation device AMN. In response to the motion command, the actuation device AMN performs a motion defined by the motion command (e.g. leftward or rightward turning).

When the actuation device AMN performs the motion defined by the motion command, a load in accordance with the operational environment and/or the operating condition acts on the actuation device AMN. As described above, the load detector 320 detects the load acting on the actuation device AMN. The load detector 320 generates a load signal to indicate the load acting on the actuation device AMN. The load signal is output from the load detector 320 to the convertor 440. The convertor 440 refers to the load signal and calculates a magnitude of the excitation current in correspondence to the load indicated by the load signal. In short, the convertor 440 converts the load indicated by the load signal into the magnitude of the excitation current. A functional formula used by the convertor 440 to calculate the magnitude of the excitation current is expressed below. Instead of the functional formula, the convertor 440 may determine the magnitude of the excitation current using a lookup table. The principle of the present embodiment is not limited to a particular calculation technique for determining the magnitude of the excitation current.

MAGNITUDE OF EXCITATION CURRENT=$F(x)$ [Formula 1]

F(x): INCREASING FUNCTION x: LOAD

A converted value obtained from the functional formula (a value indicating the magnitude of the excitation current converted from the load indicated by the load signal) is output from the convertor 440 to the command outputting portion 420. The command outputting portion 420 determines whether the converted value exceeds a predetermined threshold value. Since the functional formula "F(x)" is an increasing function of the load, the converted value takes a larger value for a greater load acting on the actuation device AMN. The converted value takes a smaller value for a smaller load acting on the actuation device AMN. The converted value exceeding the predetermined threshold value means that the load acting on the actuation device AMN exceeds a predetermined load threshold value.

The command outputting portion 420 determining that the converted value exceeds the predetermined threshold value generates an actual control command to instruct a supply of the excitation current of a magnitude equivalent to the converted value. The actual control command is output from the command outputting portion 420 to the current supplying portion 330. Under the actual control on the basis of the actual control command, the current supplying portion 330 generates an excitation current of the converted value which is instructed by the actual control command. The excitation current is supplied from the current supplying portion 330 to the excitation coil 230. The threshold value for the converted value (i.e. the load threshold value for the load acting on the actuation device AMN) and the value of an excitation current supplied under the preliminary control are set so that the excitation current supplied under the actual control is higher than the excitation current supplied under the preliminary control. The excitation current generated under the preliminary control takes a substantially constant value whereas a value of the excitation current generated under the actual control depends on the load acting on the actuation device AMN. Since the preliminary control is performed prior to the actual control, the excitation current set to the preliminary current value is supplied to the excitation coil 230 before the excitation current of a value set in correspondence to the load acting on the actuation device AMN is supplied. Therefore, there is no excessively increased amount of the set value of the excitation current even when the preliminary control is switched to the actual control. Accordingly, the excitation current may immediately reach the value set in accordance with the load acting on the actuation device AMN when the actual control is performed.

When the converted value instructed by the actual control command is high, a high excitation current is supplied to the excitation coil 230. Accordingly, large resistance is generated against the angular displacement of the rotational part 220. In this case, the operator operating the operation member 210 may feel a large force sense. On the other hand, when the converted value instructed by the actual control command is low, a low excitation current is supplied to the excitation coil 230. In this case, the operator operating the operation member 210 may feel a small force sense.

Figure 5:
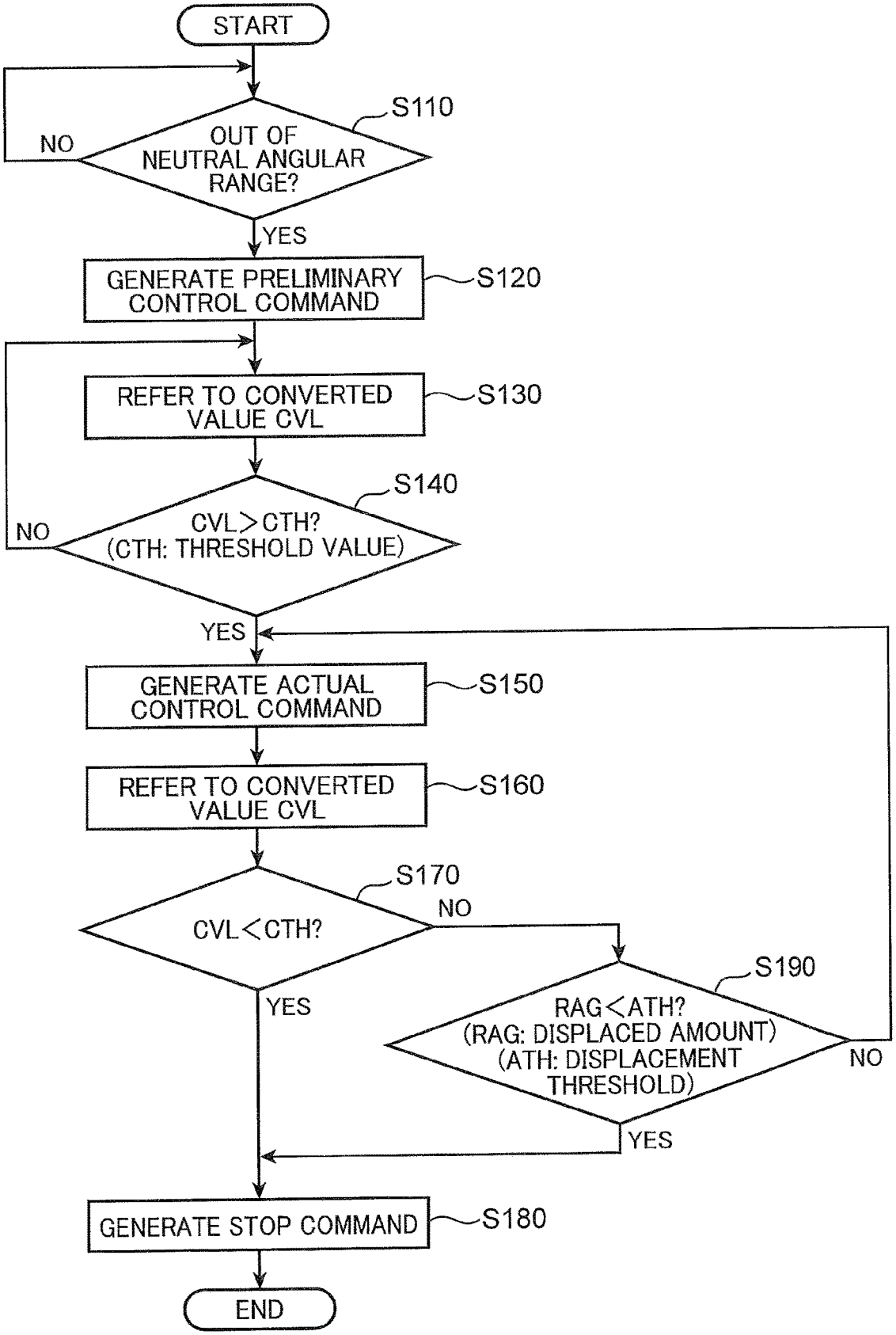
FIG. 5 is a schematic flowchart showing an exemplary operation of a command outputting portion of the force sense imparting operation device shown in FIG. 1.

FIG. 5 is a schematic flowchart showing an exemplary operation of the command outputting portion 420. An operation of the command outputting portion 420 is described with reference to FIGS. 1, 4 and 5.

(Step S110)

The command outputting portion 420 waits for a determination result indicating that the displaced amount indicated by the displacement signal exceeds the predetermined threshold value (i.e. a determination result indicating that the displaced amount of the operation member 210 and the rotational part 220 exceeds the neutral angular range). When the determination result indicating that the displaced amount indicated by the displacement signal exceeds the predetermined threshold value is output from the displacement determining portion 410 to the command outputting portion 420; step S120 is executed.

(Step S120: Preliminary Control)

The command outputting portion 420 generates the preliminary control command to instruct a supply of the excitation current set to the preliminary current value. The preliminary control command is output from the command outputting portion 420 to the current supplying portion 330. The current supplying portion 330 generates the excitation current of a value determined by the preliminary control command. After the preliminary control command is generated, step S130 is executed.

(Step S130)

The command outputting portion 420 refers to a converted value "CVL" output from the convertor 440. Step S140 is then executed.

(Step S140)

The command outputting portion 420 compares the converted value "CVL" with a predetermined threshold value "CTH". If the converted value "CVL" is higher than the threshold value "CTH", step S150 is executed. Otherwise, step S130 is executed.

(Step S150: Actual Control)

The command outputting portion 420 generates an actual control command to instruct a supply of the excitation current of a magnitude equivalent to the converted value "CVL". The actual control command is output from the command outputting portion 420 to the current supplying portion 330. The current supplying portion 330 generates an excitation current of the converted value "CVL" instructed by the actual control command. The excitation current is supplied from the current supplying portion 330 to the excitation coil 230. After the actual control command is generated, step S160 is executed.

(Step S160)

The command outputting portion 420 refers to the converted value "CVL" output from the convertor 440. Step S170 is then executed.

(Step S170)

The command outputting portion 420 compares the converted value "CVL" with a predetermined threshold value "CTH". If the converted value "CVL" is lower than the threshold value "CTH", step S180 is executed. Otherwise, step S190 is executed.

(Step S180)

The command outputting portion 420 generates a stop command to instruct stopping the supply of the excitation current. The stop command is output from the command outputting portion 420 to the current supplying portion 330. The current supplying portion 330 stops generating and supplying the excitation current in response to the stop command.

(Step S190)

The command outputting portion 420 refers to a displaced amount "RAG" indicated by the displacement signal and determines whether the displaced amount "RAG" is below a predetermined displacement threshold value "ATH". If the displaced amount "RAG" is below the predetermined displacement threshold value "ATH", step S180 is performed. Otherwise, step S150 is executed.

The displacement threshold value "ATH" is used also in the determination process performed by the displacement determining portion 410. If the displaced amount "RAG" indicated by the displacement signal from the displacement detector 310 is above the displacement threshold value "ATH", a determination result indicating that the displaced amount "RAG" of the operation member 210 and the rotational part 220 exceeds the neutral angular range is output in step S110 from the displacement determining portion 410 to the command outputting portion 420, and then step S120 is executed.

Figure 6:
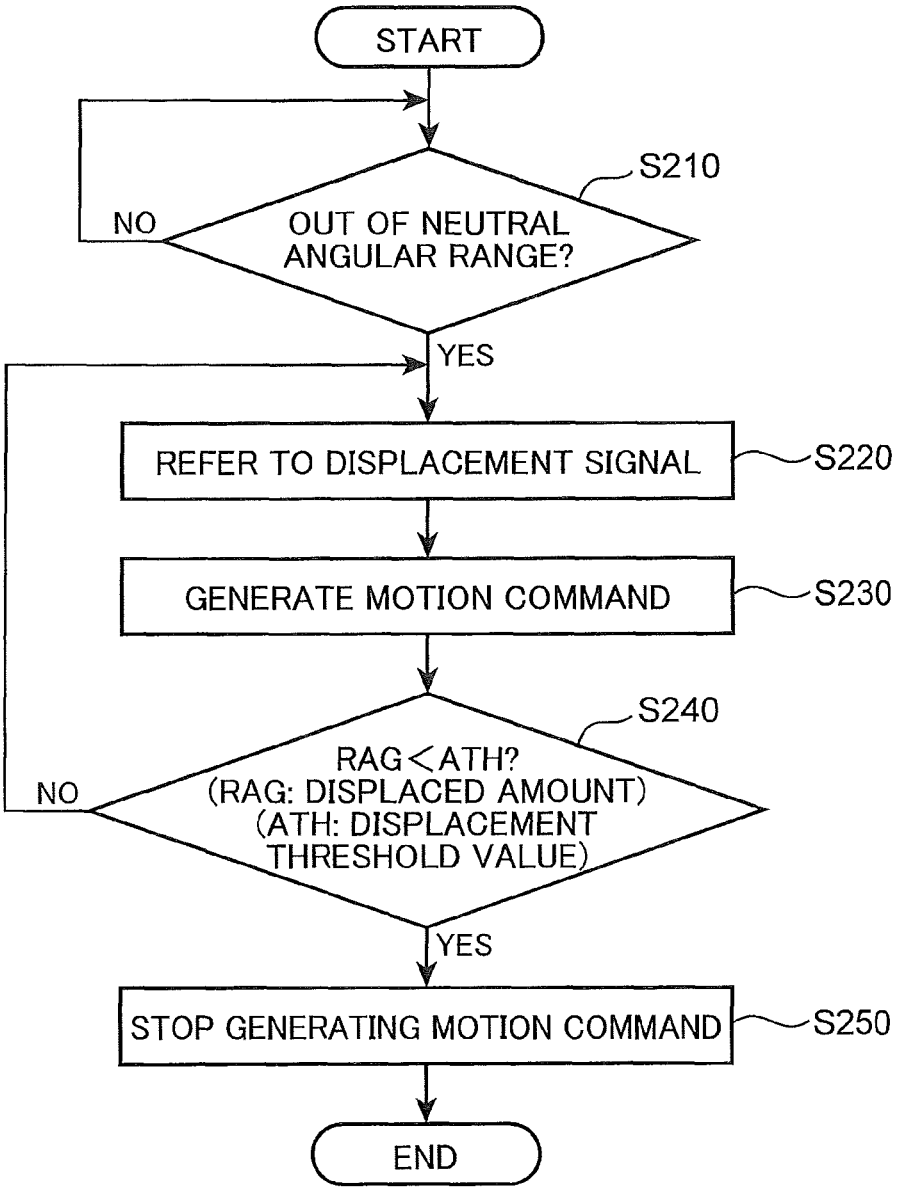
FIG. 6 is a schematic flowchart showing an exemplary operation of a motion request portion of the force sense imparting operation device shown in FIG. 1.

FIG. 6 is a schematic flowchart showing an exemplary operation of the motion request portion 430. An operation of the motion request portion 430 is described with reference to FIGS. 1, 4 and 6.

(Step S210)

The motion request portion 430 waits for a determination result indicating that the displaced amount indicated by the displacement signal exceeds the predetermined threshold value (i.e. a determination result indicating that the displaced amount of the operation member 210 and the rotational part 220 exceeds the neutral angular range). When the determination result indicating that the displaced amount indicated by the displacement signal exceeds the predetermined threshold value is output from the displacement determining portion 410 to the motion request portion 430, step S220 is executed.

(Step S220)

The motion request portion 430 refers to the displacement signal received from the displacement detector 310 via the displacement determining portion 410. The step S230 is then executed.

(Step S230)

The motion request portion 430 generates a motion command so that the actuation device AMN reaches a target position or takes a target posture in correspondence to the displaced amount "RAG" indicated by the displacement signal. The motion command is output from the motion request portion 430 to the actuation device AMN. In response to the motion command, the actuation device AMN moves to the target position or takes the target posture. After the motion command is generated, step S240 is executed.

(Step S240)

The motion request portion 430 compares the displaced amount "RAG" indicated by the displacement signal with the predetermined displacement threshold value "ATH". The displaced amount "RAG" taking a smaller value than the displacement threshold value "ATH" means that the displaced amount of the operation member 210 and the rotational part 220 is within the neutral angular range. In this case, step S250 is executed. If the displaced amount "RAG" is larger than the angular range "ATH", step S220 is executed.

(Step S250)

The motion request portion 430 stops generating the motion command. Accordingly, the actuation device AMN stops.

Figure 7:
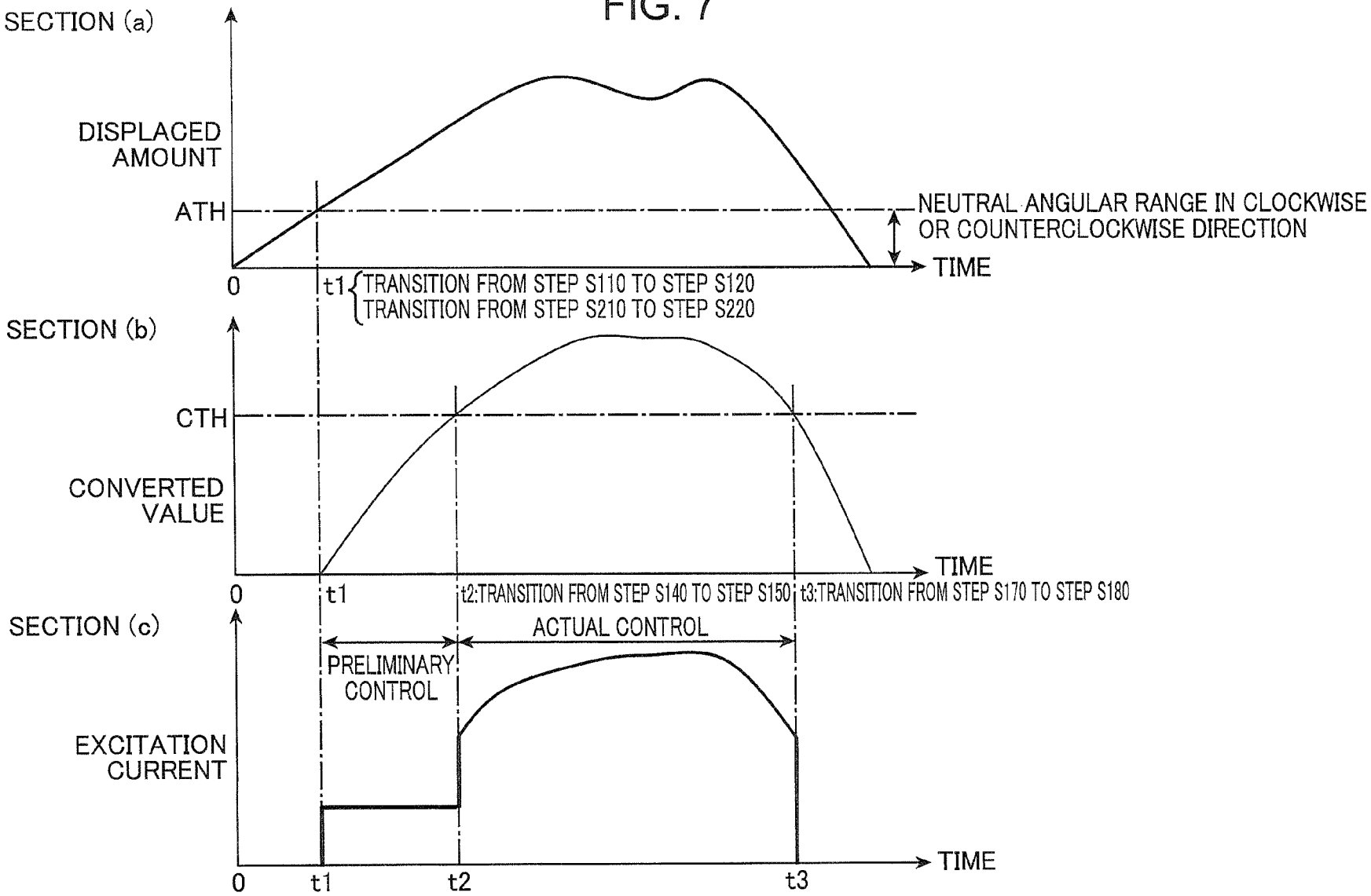
FIG. 7 is an exemplary timing chart obtained under a control flow shown in FIGS. 5 and 6.

FIG. 7 is an exemplary timing chart obtained in a control flow described in FIGS. 5 and 6. An exemplary operation of the operation device 100 is described with reference to FIGS. 1, 4 and 7.

With regard to the sections (a) to (c) in FIG. 7, the horizontal axis represents time. The vertical axis of the section (a) in FIG. 7 represents a displaced amount of the operation member 210 and the rotational part 220 from the neutral position (i.e. the displaced amount is an output voltage from the displacement detector 310). The vertical axis of the section (b) in FIG. 7 represents a converted value which is converted from a load acting on the actuation device AMN (i.e. the load is an output voltage from the load detector 320). The vertical axis of the section (c) in FIG. 7 represents an excitation current supplied from the current supplying portion 330 to the excitation coil 230.

As shown in the section (a) in FIG. 7, the displaced amount at time "t1" exceeds the displacement threshold value "ATH". At this time, process performed by the command outputting portion 420 transitions from step S110 to step S120. At the same time, process performed by the motion request portion 430 transitions from step S210 to step S220.

As a result of the transition from step S110 to S120 as shown in the section (c) in FIG. 7, the command outputting portion 420 generates the preliminary control command. The preliminary control command is output from the command outputting portion 420 to the current supplying portion 330. The current supplying portion 330 generates an excitation current of a small value in accordance with the preliminary control command. The excitation current is supplied from the current supplying portion 330 to the excitation coil 230.

As a result of the transition from step S210 to S220, the motion request portion 430 refers to the displacement signal received from the displacement detector 310 via the displacement determining portion 410, and generates the motion command in the later step S230. The motion command is output from the motion request portion 430 to the actuation device AMN. In response to the motion command, the actuation device AMN starts a motion defined by the motion command. Accordingly, a load acts on the actuation device AMN. The load detector 320 generates a load signal to indicate the load acting on the actuation device AMN. The load signal is output from the load detector 320 to the convertor 440. The convertor 440 substitutes the load indicated by the load signal into "Formula 1" to obtain a magnitude of the excitation current by the conversion.

In the section (b) in FIG. 7, the converted value (i.e. the load acting on the actuation device AMN) increases from the time "t1" and reaches the threshold value "CTH" at time "t2". At this time, the process performed by the command outputting portion 420 transitions from step S140 to S150.

As a result of the transition from step S140 to S150, the command outputting portion 420 generates the actual control command. The actual control command is output from the command outputting portion 420 to the current supplying portion 330. In response to the actual control command, the current supplying portion 330 generates an excitation, current of a magnitude equivalent to the converted value. The excitation current is supplied from the current supplying portion 330 to the excitation coil 230. The preliminary control on the basis of the preliminary control command is switched at the time "t2" to the actual control on the basis of the actual control command, so that the excitation current increases vertically at the time "t2".

As shown in the section (b) in FIG. 7, the converted value changes from the time "t2" in accordance with the load acting on the actuation device AMN. The converted value takes the threshold value "CTH" again at time "t3" which is after the time "t2". There is a decrease tendency of the displaced amount and the converted value around the time "t3". This means that the operator tries to return the operation member 210 to the neutral position. In this case, the operation device 100 does not have to make the operator feel a force sense.

At the time "t3", the process performed by the command outputting portion 420 transitions from step S170 to S180. As a result of the transition from step S170 to S180, the command outputting portion 420 generates the stop command. The stop command is output from the command outputting portion 420 to the current supplying portion 330. The current supplying portion 330 stops generating and supplying the excitation current in response to the stop command.

Figure 8A:
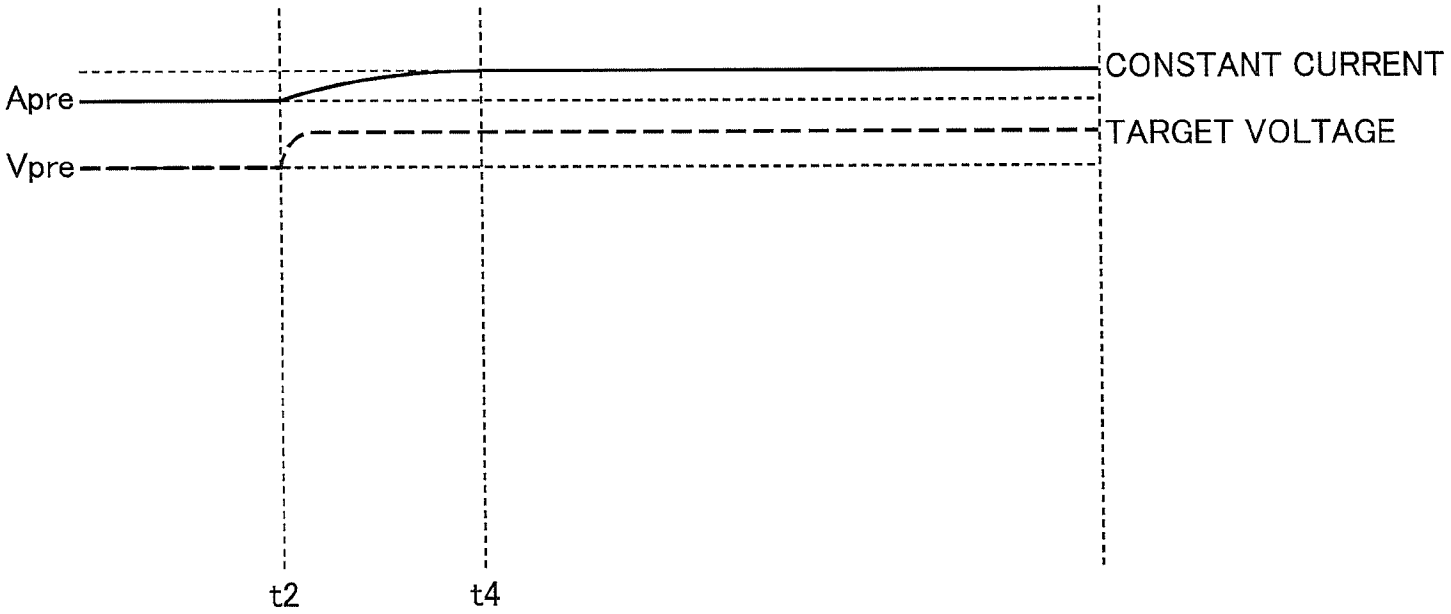
FIG. 8A is a chart showing a voltage applied to an excitation coil and an excitation current flowing in the excitation coil in accordance with an applied voltage.
Figure 8B:
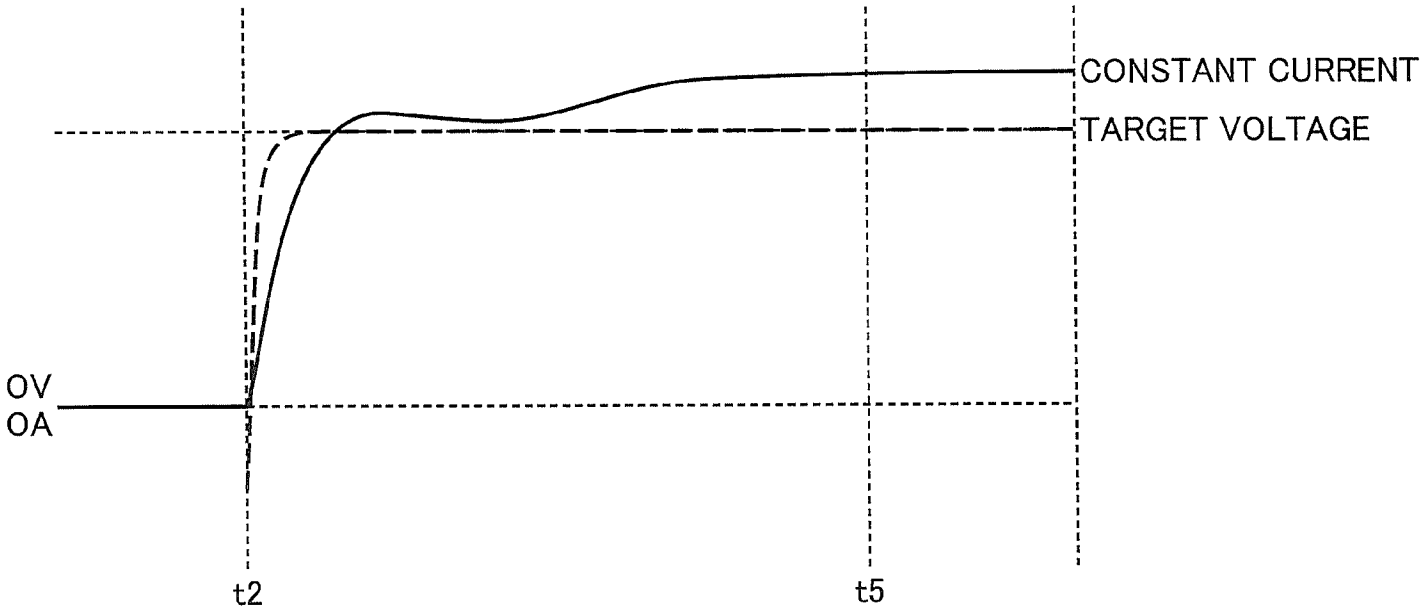
FIG. 8B is a chart showing a voltage applied to the excitation coil and an excitation current flowing in the excitation coil in accordance with the applied voltage.

FIGS. 8A and 8B are charts showing a voltage applied to the excitation coil 230 and an excitation current flowing in the excitation coil 230 in accordance with the applied voltage. An effect of the preliminary control is described with reference to FIGS. 4 and 7 to 8B.

FIG. 8A shows an applied voltage and an excitation current when the preliminary control is performed. FIG. 8B shows an applied voltage and an excitation current under a condition without the preliminary control. The target voltage and the constant current are the same in FIGS. 8A and 8B.

Without the preliminary control, the applied voltage starts changing at the time "t2" and steeply increases from "0 V" to the target voltage. When the preliminary control is performed, a predetermined preliminary voltage "Vpre" (Vpre>0) is applied to the excitation coil 230 in a period before the time "t2". Accordingly, a preliminary excitation current "Apre" flows in the excitation coil 230 in the period before the time "t2".

The change in the applied voltage at the time "t2" is smaller under the condition in FIG. 8A (with the preliminary control) than the condition in FIG. 8B (without the preliminary control). It takes a time period from the time "t2" to time "t4" for the excitation current to have a constant value under the condition with the preliminary control whereas it takes a time period from the time "t2" to time "t5", which is after the time "t4", for the excitation current to have a constant value under the condition without the preliminary control. According to the data shown in FIGS. 8A and 8B, the time period from the time "t2" to the time "t5" is about three times as long as the time period from the time "t2" to the time "t4". It can be understood that the preliminary control is very effective to provide a force sense of a target magnitude to the operator with high responsiveness.

<Other Features>

A designer may provide various features to the aforementioned operation device 100. The following features do not limit the design principle of the operation device 100.

(Determining Magnitude of Excitation Current Under Preliminary Control)

Figure 9:
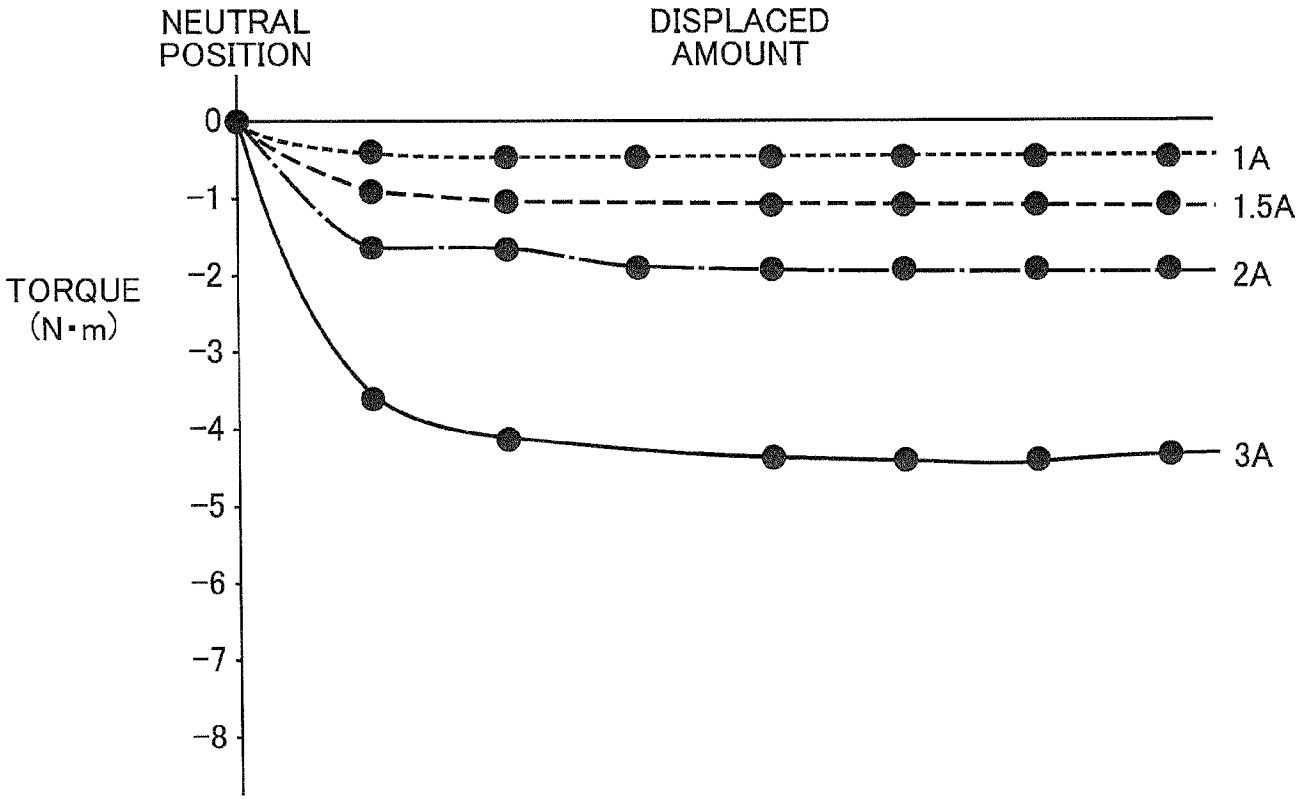
FIG. 9 is a chart showing a relationship among the excitation current flowing in the excitation coil, a displaced amount of the rotational portion, and a torque against a rotation of the rotational portion.

FIG. 9 is a chart showing a relationship among the excitation current flowing in the excitation coil 230, the displaced amount of the rotational part 220, and a torque against rotation of the rotational part 220. It is described with reference to FIGS. 1, 4 and 9 how to determine a magnitude of the excitation current for the preliminary control.

The horizontal axis of a chart in FIG. 9 represents a displaced amount of the rotational part 220 from the neutral position. The vertical axis in FIG. 9 represents a torque against a rotation of the rotational part 220. A negative sign of a value on the horizontal axis in FIG. 9 indicates that the value is resistance acting on the rotational part 220. Hereinafter, the magnitude of torque is expressed by an absolute value of the value represented by the vertical axis in FIG. 9.

If a torque against the rotation of the rotational part 220 is smaller than "1 Nm", the operator operating the operation member 210 feels almost no force sense. According to the data shown in FIG. 9, if an excitation current smaller than "1.5 A" is supplied to the excitation coil 230, a torque smaller than "1 Nm" acts on the rotational part 220. Since the object of causing an excitation current to flow under the preliminary control is not to make the operator feel a force sense but to improve responsiveness as described above, the command outputting portion 420 may generate the preliminary control command to cause the excitation current smaller than "1.5 A" to flow in the excitation coil 230. In such a case, electric power consumption of the operation device 100 under the preliminary control is kept low since an unnecessarily high excitation current is not supplied to the excitation coil 230.

(Adjustment to Magnitude of Excitation Current Under Preliminary Control)

The magnitude of the excitation current flowing under the preliminary control may be adjusted by the operator. Techniques of adjustment to the magnitude of the excitation current flowing under the preliminary control is described with reference to FIGS. 1, 4 and 8A.

As shown in FIG. 1, the operation device 100 further includes an adjustor 340. The adjustor 340 may be an operation panel mounted on the actuation device AMN or other interface device. The operator operates the adjustor 340 to adjust the magnitude of the excitation current supplied to the excitation coil 230 under the preliminary control. When the excitation current supplied to the excitation coil 230 under the preliminary control is set to a high value, there is a small difference between a target value for the actual control and a value of the excitation current supplied to the excitation coil 230 under the preliminary control. Therefore, it takes a shorter time period from the time "t2" for the excitation current to reach the target value of the force sense (the constant current shown in FIG. 8A). When the excitation current supplied to the excitation coil 230 under the preliminary control is set to a low value, there is a large difference between a target value for the actual control and a value of the excitation current supplied to the excitation coil 230 under the preliminary control. Therefore, it takes a longer time period from the time "t2" for the excitation current to reach the target value of the force sense (constant current shown in FIG. 8A). Accordingly, the operator may adjust the adjustor 340 to obtain responsiveness of the operation device 100 suitable for the operator.

(Stopping Excitation Current During Preliminary Control)

According to the control flow described with reference to FIG. 5, the displacement determination process in step S190 is performed by the command outputting portion 420 (c.f. FIG. 4). However, the displacement determination process may be performed mainly by the displacement determining portion 410 (c.f. FIG. 4). In such a case, the operation device 100 may stop the excitation current during the preliminary control.

Figure 10:
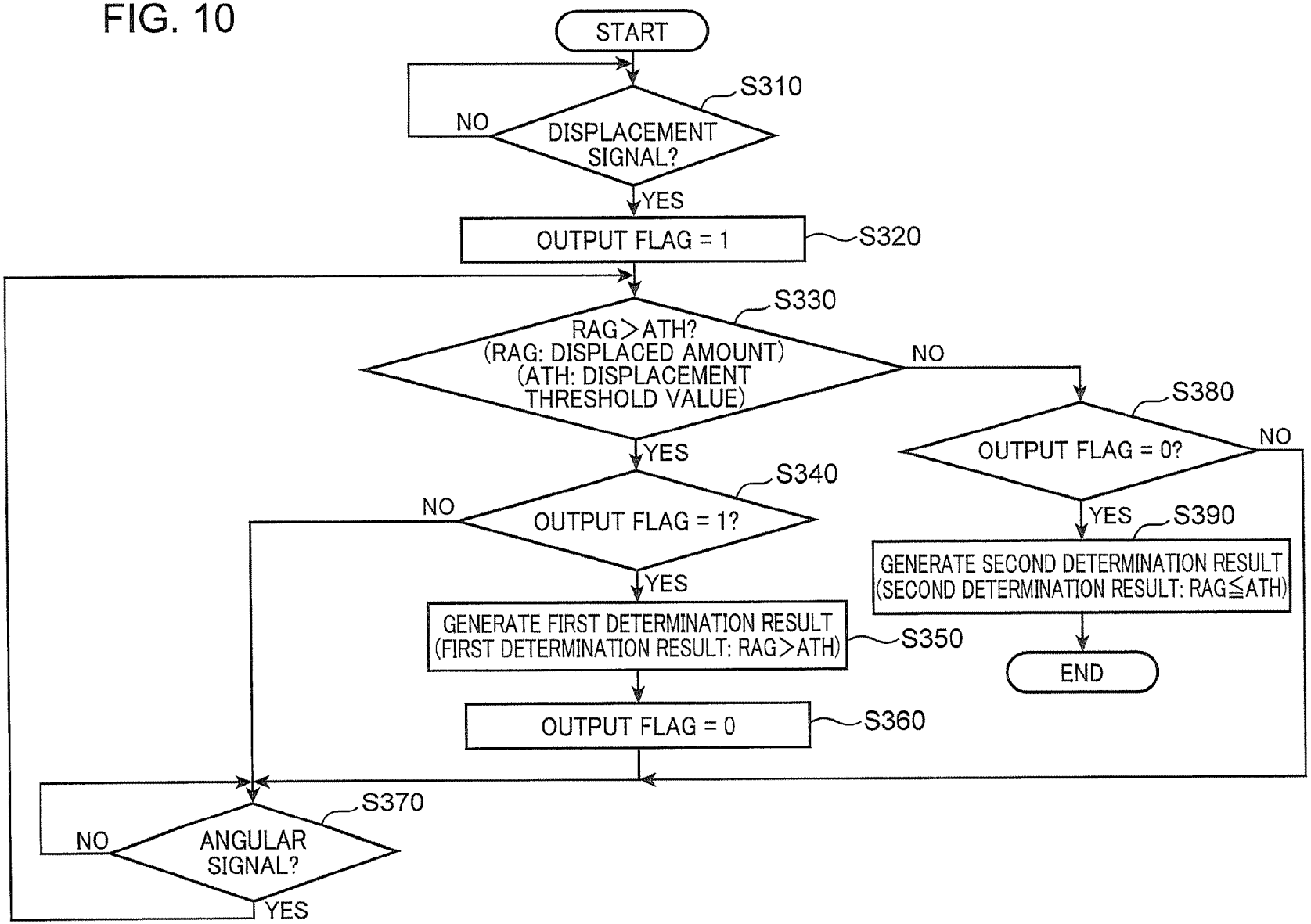
FIG. 10 is a schematic flowchart showing an exemplary operation of a displacement determining portion of the force sense imparting operation device shown in FIG. 1.

FIG. 10 is a schematic flowchart showing an exemplary operation of the displacement determining portion 410. An operation of the displacement determining portion 410 is described with reference to FIGS. 4, 7 and 10.

(Step S310)

The displacement determining portion 410 waits for the displacement signal. When the displacement determining portion 410 receives the displacement signal from the displacement detector 310, step S320 is executed.

(Step S320)

A value of an output flag used for determining whether to output a determination result is set to "1" by the displacement determining portion 410. Then, step S330 is executed.

(Step S330)

The displacement determining portion 410 compares the displaced amount "RAG" indicated by the displacement signal with the displacement threshold value "ATH". If the displaced amount "RAG" is larger than the displacement threshold value "ATH", step S340 is executed. Otherwise, step S380 is executed.

(Step S340)

The displacement determining portion 410 determines whether the value of the output flag is "1". If the value of the output flag is "1", step S350 is executed. Otherwise, step S370 is executed.

(Step S350)

The displacement determining portion 410 generates a first determination result indicating that the displaced amount "RAG" is larger than the displacement threshold value "ATH". The first determination result is output from the displacement determining portion 410 to the command outputting portion 420. After the first determination result is output, step S360 is executed.

(Step S360)

The displacement determining portion 410 sets the value of the output flag to "0". Then, step S370 is executed.

(Step S370)

The displacement determining portion 410 waits for the displacement signal. When the displacement determining portion 410 receives the displacement signal from the displacement detector 310, step S330 is executed.

(Step S380)

The displacement determining portion 410 determines whether the value of the output flag is "0". If the value of the output flag is "0", step S390 is executed. Otherwise, step S370 is executed.

(Step S390)

The displacement determining portion 410 generates a second determination result indicating that the displaced amount "RAG" is no larger than the displacement threshold value "ATH". The second determination result is output from the displacement determining portion 410 to the command outputting portion 420.

With regard to the data shown in FIG. 7, the processing loop of step S330, step S380 and step S370 is repeated in a time period from time "0" to the time "t1". The process from step S330 to S360 is executed at the time "t1". The processing loop of step S330, step S340 and step S370 is repeated in a time period from the time "t1" to the time "t2". At the time "t2", step S380 and step S390 are executed.

Figure 11:
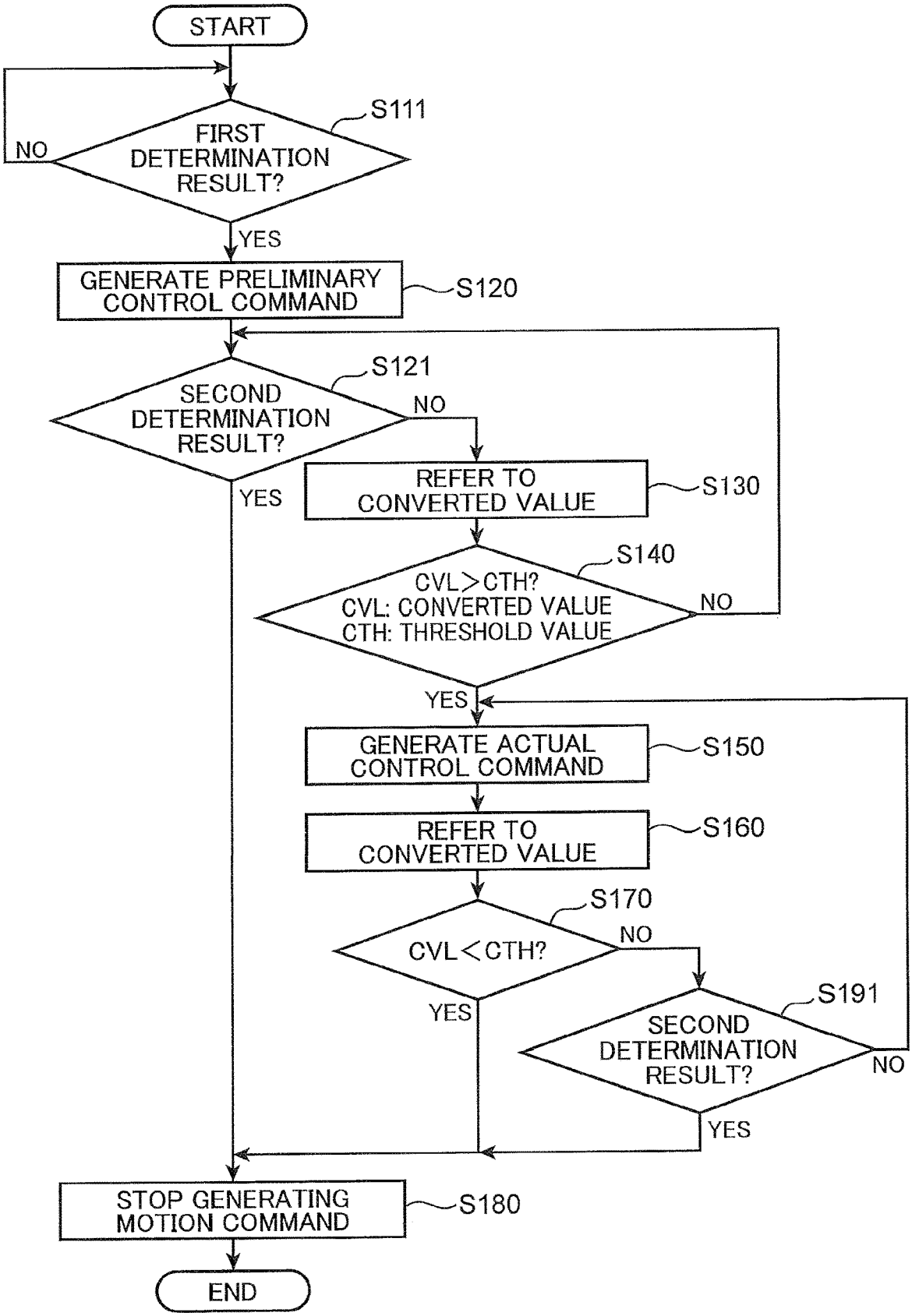
FIG. 11 is a schematic flowchart showing an exemplary operation of the command outputting portion.

FIG. 11 is a schematic flowchart showing an exemplary operation of the command outputting portion 420. An operation of the command outputting portion 420 is described with reference to FIGS. 1, 4, 5, 7, 10 and 11.

(Step S111)

The command outputting portion 420 waits for the first determination result. When step S350 described with reference to FIG. 10 is executed, the command outputting portion 420 receives the first determination result from the displacement determining portion 410. When the command outputting portion 420 receives the first determination result, step S120 described with reference to FIG. 5 is executed. The description about FIG. 5 is applicable to step S120. After step S120, step S121 is executed.

(Step S121)

The command outputting portion 420 determines whether the second determination result has been received from the displacement determining portion 410. If step S390 described with reference to FIG. 10 has been executed, the second determination result has been received by the command outputting portion 420. In this case, step S180 described with reference to FIG. 5 is executed. The description about FIG. 5 is applicable to step S180. If step S390 described with reference to FIG. 10 has not been executed, the second determination result has not been received by the command outputting portion 420. In this case, step S130 to step S170 described with reference to FIG. 5 are executed. The description about FIG. 5 is applicable to step S130 to step S170. In step S140, if the converted value "CVL" does not exceed the threshold value "CTH", step S121 is executed again. In step S170, if the converted value "CVL" is not below the threshold value "CTH", step S191 is executed.

(Step S191)

The command outputting portion 420 determines whether the second determination result has been received from the displacement determining portion 410. If step S390 described with reference to FIG. 10 has been executed, the second determination result has been received by the command outputting portion 420. In this case, step S180 described with reference to FIG. 5 is executed. If step S390 described with reference to FIG. 10 has not been executed, the second determination result has not been received by the command outputting portion 420. In this case, step S150 described with reference to FIG. 5 is executed.

Unlike the data shown in FIG. 7, the operator may try to return the operation member 210 to the neutral position during the preliminary control. For example, when the operator notices that the operation member 210 has been erroneously operated prior to performing the actual control, the operation member 210 is returned to the neutral position during the preliminary control. In such a case, the displaced amount "RAG" indicated by the displacement signal decreases during the preliminary control to be no larger than the threshold value "ATH". Then, the displacement determining portion 410 performs step S390 described with reference to FIG. 10 during the preliminary period. Accordingly, the command outputting portion 420 performs the processes of a series of step S121 and step S180 during the preliminary control. As a result of performing the processes of a series of step S121 and step S180 during the preliminary control, the supply of the excitation current resulting from execution of step S120 is stopped during the preliminary control.

The exemplary techniques described in the context of the aforementioned various embodiments mainly include the following features.

A force sense imparting operation device according to one aspect of the aforementioned embodiment configured to impart a force sense in accordance with a load acting on an actuation device which performs a predetermined motion in response to a motion request output when there is an operation causing a displaced amount exceeding a predetermined displacement threshold value from a predetermined neutral position under a stationary condition of the actuation device. The force sense imparting operation device includes an operation member operated to be displaced from the neutral position; a displacement detector configured to detect the displaced amount of the operation member from the neutral position; a load detector configured to detect the load acting on the actuation device which starts the predetermined motion in response to the motion request output when the displaced amount of the operation member exceeds the displacement threshold value; a force sense generator including an excitation coil to which an excitation current is supplied, the force sense generator being configured to generate resistance against a displacement of the operation member by the excitation current supplied to the excitation coil, so that the force sense generator imparts the force sense to an operator operating the operation member; a current controller configured to perform an actual control, under which the force sense imparted by the force sense generator is increased by increasing the excitation current in response to an increase in the load detected by the load detector, and a preliminary control, under which the excitation current set to a preliminary current value lower than the excitation current supplied to the excitation coil under the actual control is supplied to the excitation coil prior to the actual control; and a current supplying portion configured to supply the excitation current to the excitation coil under control of the current controller. The current controller performs the preliminary control when the displaced amount increases and exceeds the displacement threshold value, so that the current controller supplies the excitation current set to the preliminary current value from the current supplying portion to the excitation coil.

According to the aforementioned configuration, the current controller performs the actual control under which the excitation current is increased in accordance with an increase in the load detected by the load detector to increase the force sense imparted by the force sense generator, and the preliminary control, under which an excitation current set to a preliminary current value smaller than the excitation current supplied to the excitation coil of the force sense generator under the actual control is supplied to the excitation coil prior to the actual control. Accordingly, an increased amount of the excitation current at the start of the actual control is smaller than that of a conventional technique, in which the excitation current increases from zero amperes to a value set according to the load. Therefore, the excitation current reaches a value set in accordance with the load immediately after the start of the actual control, so that the force sense imparting operation device may impart a force sense to the operator in accordance with the load at appropriate times.

When the operator displaces the operation member from the neutral position and the displacement detector detects a displaced amount exceeding the displacement threshold value, a motion request is output to the actuation device. In response to the motion request, the actuation device starts a predetermined motion. Since the current controller performs the preliminary control to supply the excitation current set to the preliminary current value from the current supplying portion to the excitation coil, the increased amount of the excitation current at the start of the actual control is less likely to become excessively large. Accordingly, the force sense imparting operation device has improved responsiveness.

When the motion request is output to the actuation device, the actuation device starts a predetermined motion. Consequently, a load acts on the actuation device. The load detector detects the load acting on the actuation device. The load detected by the load detector is used for the actual control. The current controller performing the actual control increases the excitation current in accordance with an increase in the load to increase a force sense imparted by the force sense generator. On the basis of the force sense imparted by the force sense generator, the operator may feel the load acting on the actuation device. Accordingly, the operator may perform an operation suitable for the load acting on the actuation device.

With regard to the aforementioned configuration, it is preferable that the current controller includes a displacement determining portion configured to determine whether the displaced amount has increased and exceeded the displacement threshold value, and a command outputting portion configured to output a preliminary control command to the current supplying portion to instruct a supply of the excitation current set to the preliminary current value when the displacement determining portion determines that the displaced amount has increased and exceeded the displacement threshold value. The current supplying portion may supply the excitation current set to the preliminary current value to the excitation coil in response to the preliminary control command.

According to the aforementioned configuration, when the displacement determining portion determines that the displaced amount exceeds the displacement threshold value, the command outputting portion outputs the preliminary control command to instruct a supply of an excitation current set to the preliminary current value to the current supplying portion, so that the current supplying portion may supply the excitation current set to the preliminary current value to the excitation coil in response to the preliminary control command, independently from the load detected by the load detector. Unlike the conventional technique in which the excitation current increases from zero amperes to a value set in accordance with the load, the excitation current set to the preliminary current value is supplied prior to the actual control in which the excitation current that increases in accordance with the increase in the load is supplied to the excitation coil. Therefore, the increased amount of the excitation current at the start of the actual control is smaller than that of the conventional technique. Accordingly, it effectively becomes short that the excitation current reaches the value set in accordance with the load. Consequently, the force sense imparting operation device has preferable responsiveness.

With regard to this configuration, it is preferable that the current controller includes a convertor configured to convert a magnitude of the load into a converted value indicating a magnitude of the excitation current. The command outputting portion may output an actual control command to the current supplying portion to instruct the supplying of the excitation current set to the converted value when the actuation device starts the predetermined motion in response to the motion request and the load detector detects the load exceeding a predetermined load threshold value. The current supplying portion may supply the excitation current of the converted value to the excitation coil in response to the actual control command.

According to the aforementioned configuration, when the load acting on the actuation device exceeds a predetermined load threshold value, the command outputting portion outputs the actual control command to the current supplying portion to instruct a supply of the excitation current of the converted value converted from a magnitude of the load by the convertor. Consequently, the magnitude of the excitation current is switched from the preliminary current value to the converted value. Since the excitation current set to the preliminary current value is supplied to the excitation coil before the current supplying portion supplies the excitation current set to the converted value to the excitation coil, the increased amount of the excitation current at the start of the actual control is smaller than that of the conventional technique, unlike the conventional technique in which the excitation current increases from zero amperes to the value set in accordance with the load. Therefore, it becomes short effectively that the excitation current reaches the converted value converted from the excitation current in accordance with the magnitude of the load. Consequently, the force sense imparting operation device has preferable responsiveness.

With regard to this configuration, it is preferable that the command outputting portion outputs a stop command to the current supplying portion to instruct stopping the supply of the excitation current when the displaced amount decreases from a value above the displacement threshold value to a value below the displacement threshold value. The current supplying portion may stop the supply of the excitation current to the excitation coil in response to the stop command.

According to the aforementioned configuration, the operator does not have to feel the force sense when the displaced amount decreases from a value above the displacement threshold value to a value below the displaced amount because the operator tries to stop the actuation device. The current supplying portion stops the supply of the excitation current to the excitation coil in response to the stop command output from the command outputting portion when the displaced amount decreases from a value above the displacement threshold value to a value below the displacement threshold value. Accordingly, an unnecessary excitation current is not supplied to the excitation coil. Therefore, the force sense imparting operation device may achieve a low power consumption to impart a force sense to the operator.

With regard to this configuration, it is preferable that the command outputting portion outputs a stop command to the current supplying portion to instruct stopping the supply of the excitation current when the load decreases from a value above the load threshold value to a value below the load threshold value. The current supplying portion may stop the supply of the excitation current to the excitation coil in response to the stop command.

According to the aforementioned configuration, the operator does not have to feel the force sense when the load decreases from a value above the load threshold value to a value below the load threshold value because the operator tries to stop the actuation device. The current supplying portion stops the supply of the excitation current to the excitation coil in response to the stop command output from the command outputting portion when the load decreases from a value above the load threshold value to a value below the load threshold value. Accordingly, an unnecessary excitation current is not supplied to the excitation coil. Therefore, the force sense imparting operation device may achieve a low power consumption to impart a force sense to the operator.

With regard to this configuration, it is preferable that the command outputting portion outputs the stop command to the current supplying portion when the displaced amount decreases under the preliminary control. The current supplying portion may stop the supply of the excitation current to the excitation coil in response to the stop command.

According to the aforementioned configuration, the current supplying portion stops the supply of the excitation current to the excitation coil in response to the stop command output from the command outputting portion when the displaced amount decreases under the preliminary control, so that supply of the excitation current to the excitation coil is immediately stopped when the operator displaces the operation member toward the neutral position prior to the actual control.

With regard to this configuration, it is preferable that the force sense imparting operation device further includes an adjustor configured to change the preliminary current value under an operation performed by the operator.

According to the aforementioned configuration, the operator may use the adjustor to adjust the preliminary current value. If the preliminary current value is increased by the operator, it becomes short that the excitation current reaches the value set in accordance with the load. If the preliminary current value is decreased by the operator, it becomes longer that the excitation current reaches the value set in accordance with the load. Accordingly, the operator may adjust responsiveness of the force sense so that an imparted force sense becomes suitable for an operation feeling of the operator.

INDUSTRIAL APPLICABILITY

The principle of the aforementioned embodiments may suitably be used in various working machines.

The invention claimed is:

1. A force sense imparting operation device that imparts a force sense in accordance with a load acting on an actuation device which performs a predetermined motion in response to a motion request output when there is an operation causing a displaced amount exceeding a predetermined displacement threshold value from a predetermined neutral position under a stationary condition of the actuation device, the force sense imparting operation device comprising:

an operation member operated to be displaced from the neutral position;

a displacement detector that detects the displaced amount of the operation member from the neutral position;

a load detector that detects the load acting on the actuation device which starts the predetermined motion in response to the motion request output when the displaced amount of the operation member exceeds the displacement threshold value;

a force sense generator including an excitation coil to which an excitation current is supplied, the force sense generator generating resistance against a displacement of the operation member by the excitation current supplied to the excitation coil, so that the force sense generator imparts the force sense to an operator operating the operation member;

a converter, connected to the load detector, that determines a magnitude of the excitation current based on the load detected by the detector;

a processor, connected to the displacement detector, that determines whether the displaced amount detected by the displacement detector exceeds a displacement threshold value, receives information about the magnitude of the excitation current determined by the converter and a determination result of the processor, the processor outputting a preliminary control command to instruct supply of the excitation current at a fixed preliminary current value when it is shown in the determination result obtained from the processor that the displaced amount detected by the displacement detector exceeds the displacement threshold value; and a current supplying circuit, connected to the processor and the excitation coil, that supplies the excitation current to the excitation coil, wherein the processor outputs an actual control command after outputting the preliminary control command when the magnitude of the excitation current determined by the converter exceeds a threshold value which is larger than the fixed preliminary current value, the actual control command instructing output of the excitation current at the magnitude determined by the converter, and wherein the current supply circuit outputs the excitation current at the magnitude instructed by the preliminary control command in response to the preliminary control command, and outputs the excitation current at the magnitude instructed by the actual control command in response to the actual control command.

2. The force sense imparting operation device according to claim 1, wherein the processor outputs a stop command to the current supplying circuit to instruct stopping of the supply of the excitation current when the displaced amount detected by the displacement detector decreases from a value above the displacement threshold value to a value below the displacement threshold value, and wherein the current supplying circuit stops the supply of the excitation current to the excitation coil in response to the stop command.

3. The force sense imparting operation device according to claim 1, wherein the processor outputs a stop command to the current supplying circuit to instruct stopping of the supply of the excitation current when the magnitude of the excitation current determined by the converter decreases from a value above the threshold value to a value below the threshold value, and wherein the current supplying circuit stops the supply of the excitation current to the excitation coil in response to the stop command.

4. The force sense imparting operation device according to claim 2, wherein the processor outputs the stop command to the current supplying circuit when the displaced amount detected by the displacement detector decreases during the supply of the excitation current at the magnitude instructed by the preliminary control command, and wherein the current supplying circuit stops the supply of the excitation current to the excitation coil in response to the stop command.

5. The force sense imparting operation device according to claim 1, further comprising an adjustor that changes the preliminary current value under an operation performed by the operator.

6. The force sense imparting operation device according to claim 1, wherein the processor outputs a stop command to the current supplying circuit to instruct stopping of the supply of the excitation current when the magnitude of the excitation current determined by the converter decreases from a value above the threshold value to a value below the threshold value, wherein the current supplying circuit stops the supply of the excitation current to the excitation coil in response to the stop command, wherein the processor outputs the stop command to the current supplying circuit when the displaced amount detected by the displacement detector decreases during the supply of the excitation current at the magnitude instructed by the preliminary control command, and wherein the current supplying circuit stops the supply of the excitation current to the excitation coil in response to the stop command.

* * * * *